United States Patent [19]

Haynes

[11] 4,095,493

[45] Jun. 20, 1978

[54] TONG LOCKING MECHANISM

[75] Inventor: Charles W. Haynes, Spring, Tex.

[73] Assignee: Joy Manufacturing Company, Pittsburgh, Pa.

[21] Appl. No.: 791,752

[22] Filed: Apr. 28, 1977

[51] Int. Cl.[2] ..... B25B 17/00

[52] U.S. Cl. ..... 81/57.15; 81/57.18; 81/57.33

[58] Field of Search ..... 81/57.15–57.21, 81/57.33–57.35

[56] References Cited

U.S. PATENT DOCUMENTS

| | | | |
|---|---|---|---|
| 2,705,614 | 4/1955 | McKibben et al. | 81/57.16 |
| 2,985,455 | 5/1961 | Powell | 81/57.2 |
| 3,799,009 | 3/1974 | Guier | 81/57.2 |
| 3,902,385 | 9/1975 | Haby | 81/57.3 X |

*Primary Examiner*—James L. Jones, Jr.

[57] ABSTRACT

This invention relates to a door mechanism for a rotary power tong, such as used in well drilling operation. The door is pivoted to one of the bifurcated portions of the tong and a door locking mechanism is used to attach the swinging end of the door to the other bifurcated portion of the tong. At least one contact surface is attached to the door to transmit forces to the door and engage a hook-like member attached to the tong frame. At least one contact member is attached to the frame to transmit forces to the frame and engage a hook-like member attached to the door. Such contact engagements provide for door support in both radial and tangential directions.

8 Claims, 5 Drawing Figures

TONG LOCKING MECHANISM

This invention relates to a door mechanism for a rotary tong. Such rotary tongs are used in well drilling operations to make-up and break-out drill strings. The tong is used to grip and rotate lengths of pipe or rods that are connected together by threaded end sections. In drilling operations such pipes are joined by tongs which exert large rotational torques to such pipes. It is desirable that the tong be of the open headed type, having a bifurcated frame with a central opening and an outwardly open passageway. With this type of construction the tong can easily be positioned on the pipe joints without the necessity of lowering the tong over the length of the pipe. It is well known that the large torque and resulting forces involved in such operation cause the bifurcations on the tong to separate or spring apart. To strengthen such a tong it is known to place a door extending between the ends of the bifurcations.

When the tong is operated a pipe gripping means or jaws located in the central opening revolve. During part of this rotation, the rotor is supported by the tong door which creates additional forces on the door and on the tong. Existing doors either lack the strength to prevent the door from springing apart during rotor support, or are complex and result in excessive coat and difficult operation. This invention provides for a door mechanism that secures the tong and door against both radial and separating forces as present during rotor support by having at least one load bearing contact surface perpendicular to each of these forces.

Accordingly, one object of this invention is to provide for a door locking mechanism to contain forces in both radial and tangential directions.

An additional object of this invention is to prevent the tongs from spreading apart while the rotor is being supported in the passageway.

Another object of this invention is to provide a door locking mechanism which can be open and closed in one motion by one hand.

Another object of this invention is to provide a latching mechanism where the latch release does not require manual operation as the door is closed and locked.

Another object of this invention is to provide for a multi-function pin which acts as both a latching contact surface and pivot point for a hook-like latch.

Another object of this invention is to provide for an inexpensive method of retaining a locking pin.

Other objects and advantages of the invention will become apparent by reading the following description and upon reference to the drawings, in which.

Figure 2:
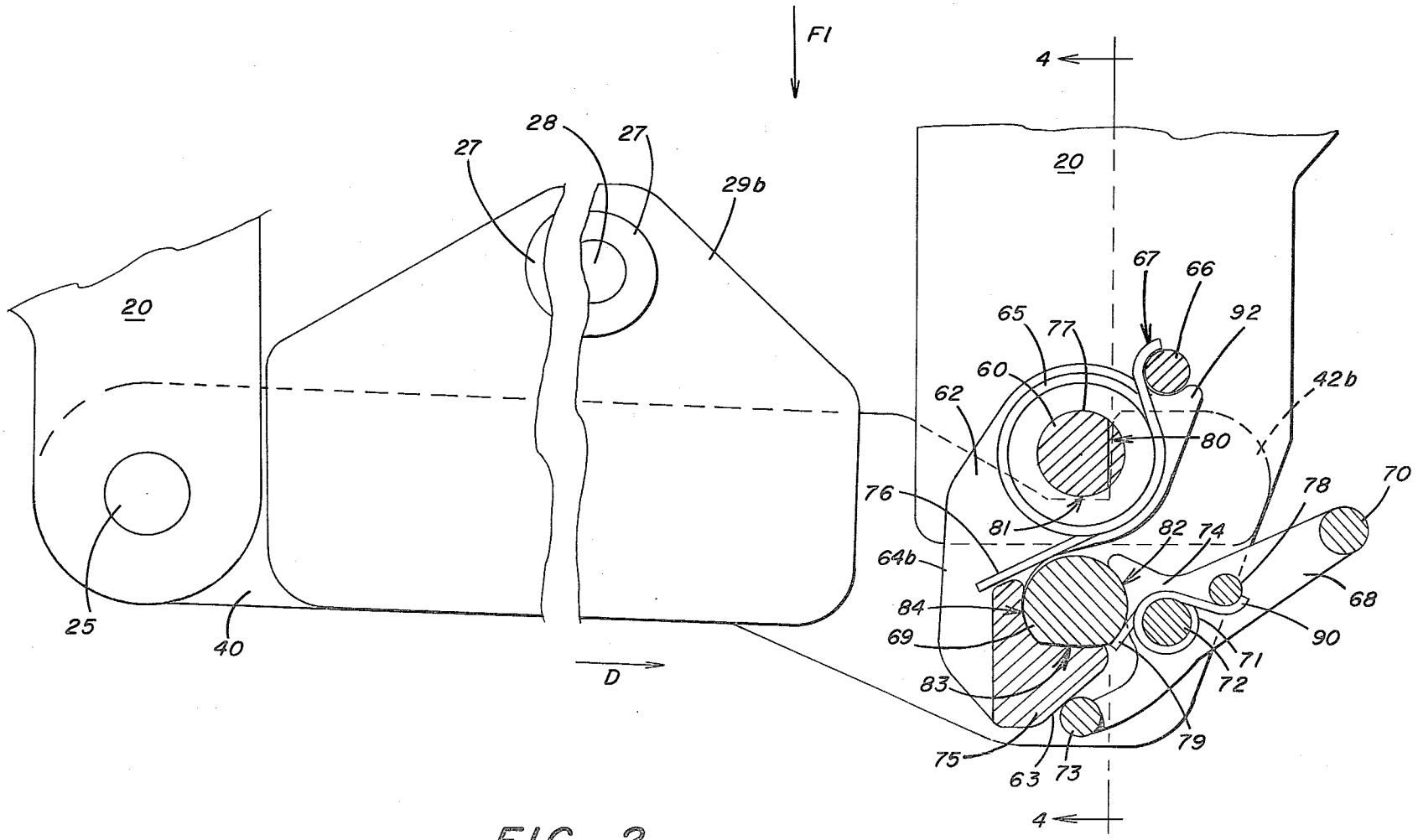
FIG. 2 is an enlarged plan view in partial section of the door and frame members showing the integral detail of the latching mechanism.
Figure 4:
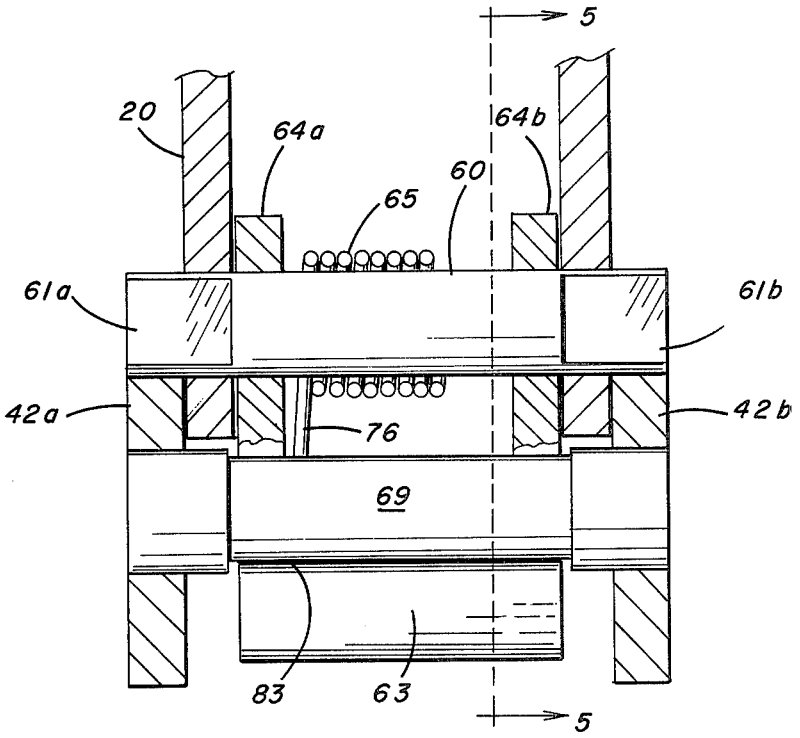
Figure 5:
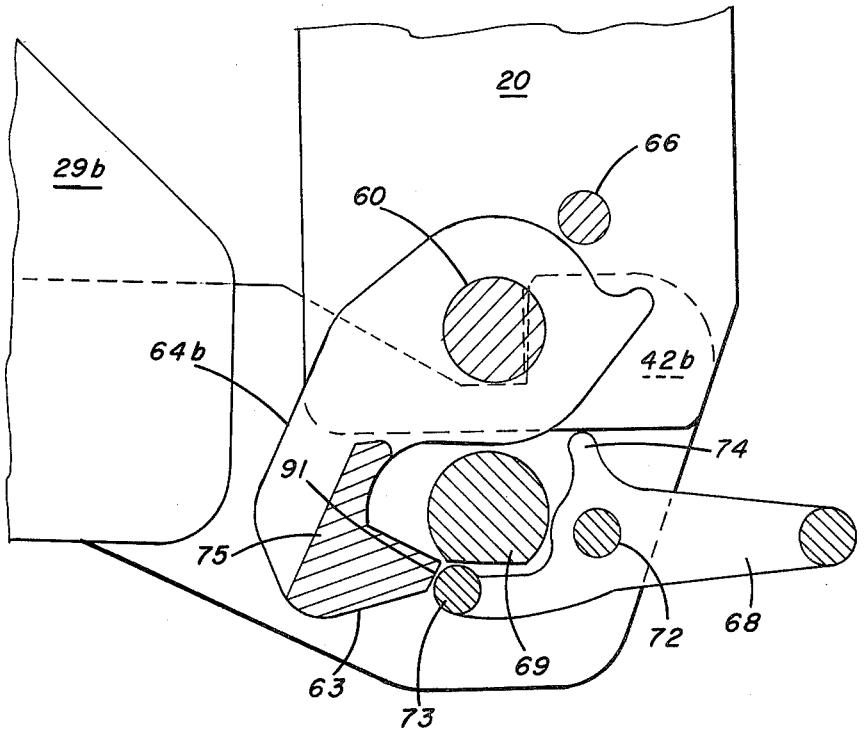

FIG. 4 is a side elevational view in partial section as taken on line 4—4 of FIG. 2 with the release lever 68 removed to show detail of the latching mechanism; and FIG. 5 is an enlarged plan view in partial section similar to FIG. 2 with the springs 65 and 71 removed to show detail; while the door is in the closed position and unlocked prior to opening.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

Referring to drawing 1 there is shown a rotary power tong having a bifurcated frame 20, forming a central opening in the area of the cross lines on F1, and an outwardly open passageway generally indicated by reference 26. Outward as referenced herein implies a direction generally away from the center of the tong opening, such center being indicated by intersection of the crossed lines on F1. Such center also indicates the axis of the central opening and the axis of rotation of the rotor. Mounted in the central opening is a rotor 22 which has a gripping means or jaws 23*a* and 23*b* attached. The rotor 22 can be peripherally driven by drive means mounted within the frame and rotor drive means shown generally as reference 24. Lifting means and handles 21 generally allow for positioning of the tong on pipe lengths. The passageway 26 communicates with the central opening and, is open to the exterior of the frame except for a pivotally mounted tong door 40. The tong door 40 is hinged at one end to one of the bifurcations of the frame by means of a door pivot pin 25. Two rotor support plates 29*a* and 29*b* are also attached to the tong door. Rotor support pins 28 connecting between the upper and lower rotor support plate provide means for supporting the rotor as it travels through the passageway.

During operation of the power tong large forces and torques are exerted by the rotor 22. Some of these forces as present on the frame and door are indicated as F1 and F2. F2 shows the direction of rotational forces or torque as they may be exerted during a make-up or break-out operation. F1 shows a radial force outward. Both the door and its mountings must be capable of sustaining these forces and resisting their effort to separate or spring the bifurcated portions of the frame support.

Figure 1:
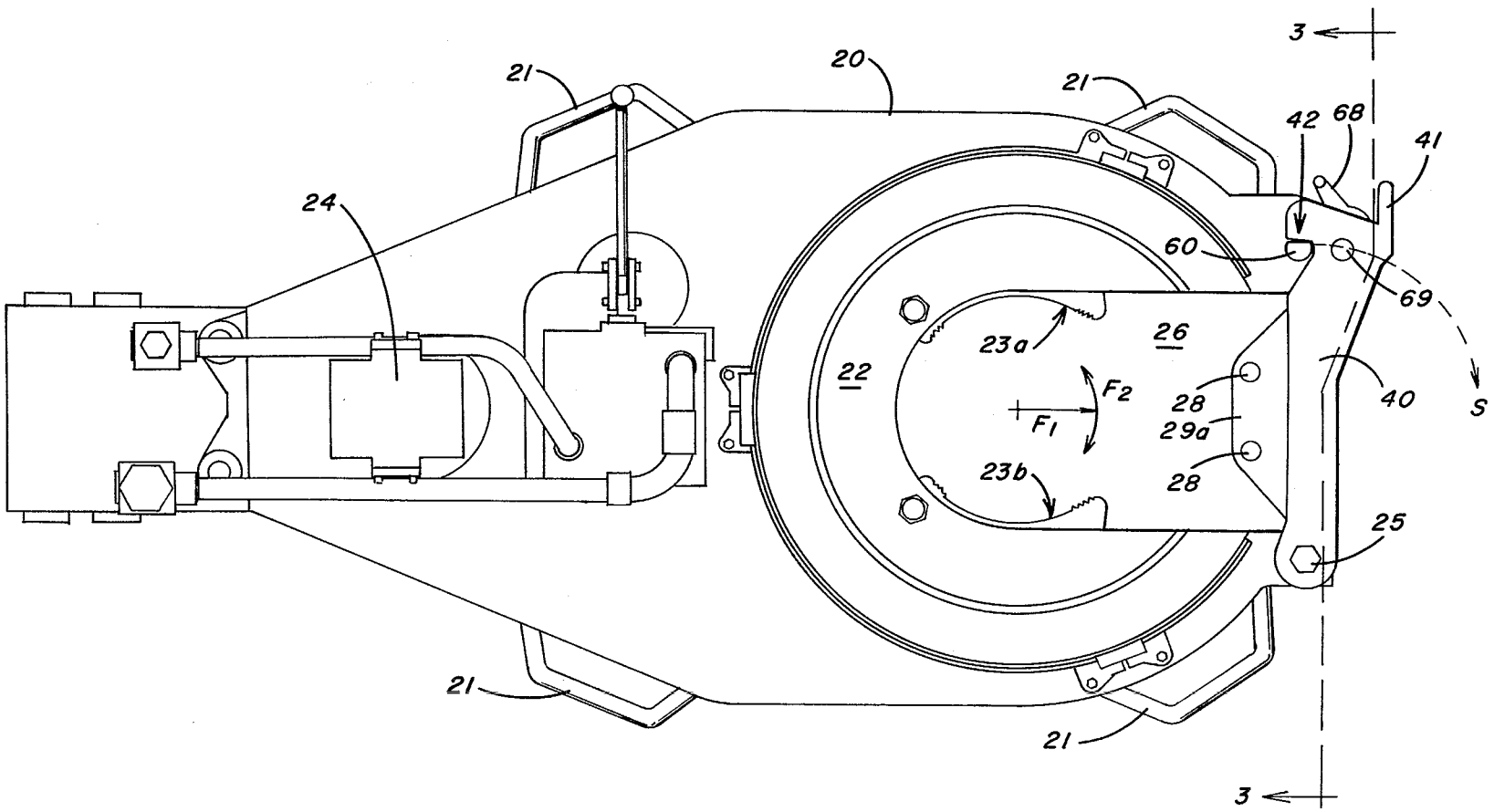
FIG. 1 is a plan view of a rotary power tong with the rotor aligned with the passageway and the tong door closed and locked.

This invention provides for resisting both the separating and the outward forces exerted by the tong by means of having at least one contact means such as a pin engage a corresponding hook-like structure in a direction corresponding to these forces. The contact means or pin may have a flat surface to ensure engagement of the hook at a proper angle. Such surface corresponding to the separating forces resulting from torque in the direction of F2 should be facing outward and generally parallel to the plane that bisects the passageway and passes through the axis of the central opening. This surface will be generally perpendicular to the separating force at the door, as shown in FIG. 1 where door hook 42 engages the multi-function pin 60.

The contact means to resist the outward or radial forces of the tong, such as F1, should be generally perpendicular to the plane that bisects the passageway and passes through the axis of the central opening when the door is in the closed position. Such a contact means having a generally flat surface is shown in FIG. 2 on the door pin 69 at point 83. It is the combination of two surfaces, one for radial forces and one for separating forces, that secure the door during rotor operation.

In addition to sustaining the forces resulting from rotation of the rotor, the door locking mechanism must provide quick and easy access to the rotor and jaws to engage the pipe. To provide this access the door hinges open in a direction as shown in FIG. 1 by the arc S. The tangential direction of swing of the door is the outward directed tangent to this arc at a point on the contact means. To open the door from a closed and locked position it is only necessary to pull outward on the release lever 68. Such operation of the release lever 68 allows the internal hook-like member to disengage the door pin 69. The door hook 42 is then free to rotate away from the multi-function pin 60. It can be seen in FIG. 1 that the door hook 42 engages the multi-function pin 60 in such a manner as to provide a restraining force in a direction perpendicular to F1 between the bifurcations of the tong frame. The engagement of door hook 42 and multi-function pin 60 act to restrain the expanding effects of the rotational torques F2 on the bifurcated frame portion.

Referring to FIG. 2 there is shown an enlarged plan view of the door fragmented and the adjacent sides of the frame bifurcations 20. In this view, the upper portion of the door hook 42*a* has been removed to better expose the internal mechanism of the latch. This drawing shows the door 40 as pivotally connected to the frame 20 by the door pivot pin 25. Also shown are rotor supports 27 which are positioned on rotor support pins 28 intermediate the rotor support plates 29*a* and 29*b*. The direction F1 is shown to indicate the general direction of the passageway opening. The additional direction D is shown to indicate the direction of the door closure. The lower door hook 42*b* can be seen to engage the multi-function pin 60. At the area indicated by the reference figure 80 the door hook 42 contacts the multi-function pin 60 to provide for a rigid support between the door and the frame member. This contact provides for support in the direction parallel to the door closure D. It can readily be understood that the torques generated within the tong tend to separate the bifurcated frame portions 20 and that this contact between the door hook 42 and the multi-function pin 60 resist these separation forces. The door hook 42 contacts the multi-function pin 60 in the proximity of 81 and prevents the door from further closing so that the rotor supports 27 do not invade the passageway and prohibit rotation of the rotor 22. The area of force contact between the door hook 42 and the multi-function pin 60 in this embodiment is a flat surface lying parallel to F1 the direction of the passageway, and lying in a plane perpendicular to the plane of the door swing S as shown in FIG. 1.

The multi-function pin 60 is firmly attached to the frame 20 and functions not only as a contact means for engaging the door hook 42, but in addition, acts as a means for rotatably securing the hook-like frame member or latch 62. The latch is free to rotate about the multi-function pin 60 until the latch stop 92 contacts the latch spring pin 66. The latch 62 is composed of three parts. An upper bifurcation portion 64*a* and a lower bifurcation portion 64*b*, both having a bore 77 for the multi-function pin 60. Intermediate and connecting these two latch bifurcation portions is a latch hook 75 having a surface at reference 83 to engage a mating surface on the door contact means or door pin 69. As the latch 62 rotates to engage the door pin 69 its rotation is also stopped by contact between the hook 75 and door pin 69 at the point shown at 84.

Force means urge the latch 62 into engagement with the door pin 69. Such force means as shown in this embodiment comprise a coil spring 65 mounted concentrically around the multi-function pin 60. This latch spring 65 has an extension 67 which engages the latch spring pin 66. A tension is exerted on the latch spring arm 76 which contacts the latch 62 in the area of the latch hook 75. The engagement of the door pin 69 and the latch hook 75 provide means for transmitting forces between the door 40 and the frame 20 in a direction parallel to F1 and generally perpendicular to the direction D. This hook and pin combination prevents the door from swinging open in the direction S as the rotor transverses the passageway.

When the door is closed and locked the release lever 68 contacts the door pin 69 by means of a release stop extension 74. This stop 74 contacts the door pin at a point indicated by the reference 82. This release lever 68 operates as a means to disengage the hook 75 from the door pin 69. When an outward force is exerted on the release handle 70 the release lever 68 is caused to pivot around the release pin 72 forcing the release contact column 73 to engage the sloping surface on the latch contour 63. As the release lever is further rotated the contact between the release column and the latch contour surface 63 causes the hook 75 to rotate counterclockwise. When the release lever 68 has been rotated such that the release contact column 73 contacts the door pin 69 further pressure on the release handle 70 causes the door to swing open in a direction as shown on FIG. 1 at S. During closed and locked operation of the tong door the release lever 68 is not held in forceable contact with the contour surface 63. The release spring 71, coiled around the release pivot pin 72 is held in tension by contact of the release spring extension 90 with the release spring 78 so as to bear the release spring arm 79 against the door pin 69. Such spring tension causes the release lever 68 to remain in forceable contact at the point 82 with the door pin 69, thereby maintaining the release contact column 73 in a nonbearing position with respect to the latch contour surface 63.

Figure 3:
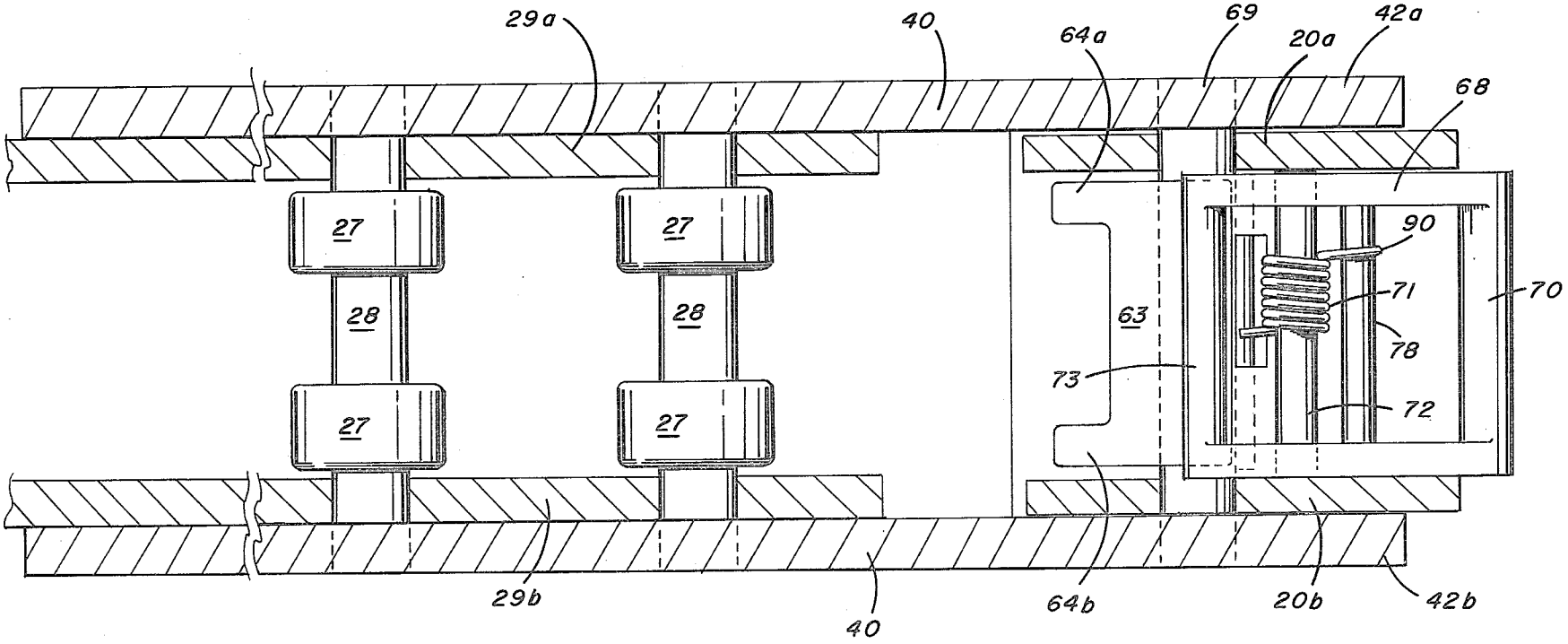
FIG. 3 is an enlarged elevational view in section as taken on line 3—3 of FIG. 1.

Referring to FIG. 3 there is shown a cross section of the tong door 40. Shown are four rotor supports 27 mounted on respective rotor support pins 28. It is to be understood that additional known rotor support means could be added and such means could include other than roller type supports. The release lever 68 is shown with release handle 70 in a door closed position. The release spring 71 is centrally positioned of the release spring pin 72 so that the release spring extension 90 contacts the release spring pin 78. The release spring also bears against the door pin 69 which causes the release contact column 73 to remain in a nonforce bearing position with respect to the latch contour surface 63. The bifurcated latch 68 can be seen to have bifurcation members 64*a* and 64*b*. The door hook in this embodiment comprises a bifurcated hook having upper and lower portions 42*a* and 42*b* respectively. The hook-like frame member or latch 62, having a latch contour surface 63, is positioned between the bifurcated door hook portions 42*a* and 42*b*.

Referring now to FIG. 4 there is shown a side elevational view in which the release lever 68 has been removed. The hook-like frame member or latch can be seen as comprising bifurcation for members 64*a* and 64*b* connected by the latch hook having a latch contour surface 63. The contact surface between the latch hook and door contact means such as the door pin 69 is shown at reference 83. The multifunction pin 60 is shown as it extends between door hook portions 42*a* and 42*b*. The contact means as embodied in contact surface 61*a* and 61*b* act both as contacting surfaces for the door hook 42 and as a means to retain the multifunction pin 60 firmly within the frame 20. These flat surfaces are arranged to interlock with the frame 20 so as to prevent rotation and axial movement of the multi-function pin 60. The latch spring 65 functions as a force means to urge the latch into contact with the door pin 69. The latch spring arm 76 bears upon the latch hook 75.

Referring now to FIG. 5 there is shown the door in the closed position and in an unlocked condition. The latch and release springs 65 and 71 have been removed for clarity. In the unlocked position the door hook **42*b* is still in an engaged position with the multi-function pin 60. The pressure of the release contact column 73 on the latch contour surface 63 has caused the latch hook 75 to disengage the door pin 69, and further rotation of the release lever 68 does not cause rotation of the latch hook due to the taper 91. Further pressure on the release lever 68 or door handle 41 would result in the door swinging open. As the door swings open the latch 62 returns to contacting the latched spring pin 66**.

As an open tong door is closed the door pin 69 forceably contacts the latch contour surface 63 and causes the latch hook 75 to rotate in a clockwise direction as viewed in FIG. 5. Because the release lever 68 is urged, by a force means such as the release spring 71, away from contour surface 63, the hook 75 is caused to rotate into engaging contact with the door pin 69 by a force means such as the latch spring 65. Such contact between the contour surface 63 and the door pin 69 allows the door to be closed or slammed without manual operation of the release mechanism.

Thus, it is apparent that there has been provided, in accordance with the invention, a rotary tong locking mechanism that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A rotary power tong for the make-up and break-out of drilling rods and pipes comprising: a bifurcated frame having first and second portions defining a central opening and an outwardly open passageway in communication with said central opening; rotatable gripping means mounted in said central opening for holding and rotating rod or pipe about the axis of said central opening; pivoting means attached to said first frame portion; a door attached to said pivoting means; at least one door contact means attached to said door for transmitting force to said door; at least one frame contact means attached to said second frame portion for transmitting forces to said second frame portion; at least one hook-like door member operably connected to said door to engage said frame contact means; and at least one hook-like frame member rotatably connected to second frame portion so as to engage and disengage said door contact means.

2. A rotary power tong as recited in claim 1 wherein said hook-like frame member is rotatable about said frame contact means.

3. A rotary power tong as recited in claim 2 wherein said hook-like door member is bifurcated.

4. The rotary power tong of claim 3 wherein said hook-like frame member is rotatably mounted about said frame contact means and engages said door contact means intermediate said bifurcated hook-like door member.

5. The rotary power tong of claim 4 further comprising force means to urge said rotatable hook-like frame member into engaging relation with said door contact means.

6. The rotary power tong as recited in claim 5 further comprising release means to exerting a force on said rotatable hook-like frame member opposing said force means so as to disengage said rotatable hook-like frame member from said door contact means.

7. A rotary power tong for use in make-up or break-out of drilling rod and pipe comprising: a bifurcated frame having first and second frame portions defining a central opening and an outwardly open passageway communicating with said central opening; a rotatable gripping means mounted in said central opening for holding and rotating rod and pipe about the axis of said central opening; pivoting means attached to said first frame portion; a door having one side attached to said pivoting means and the opposite side having formed a bifurcated hook portion; a frame pin attached to said second frame portion having end portions with flat surfaces lying generally parallel to the plane which bisects said passageway and passes through the axis of said central openings, said frame pin having an intermediate portion of larger cross-sectional area than said end portion whereby said pin is fixably attached to said second frame portion; said flat surfaces positioned to engage said bifurcated hook portions; a door pin attached intermediate said bifurcated hook portions; a latch rotatably mounted about said frame pin to engage said door pin; spring means mounted concentric with said frame pin for urging said latch into engagement with said door pin; and release means mounted on said door to contact said latch and pivotally oppose said spring means thereby urging said latch to disengage said door pin.

8. The rotary power tong of claim 7 wherein said flat surfaces of said end portions contact said second frame portions so that said frame pin is nonrotatably attached to said second frame portion.

* * * * *

UNITED STATES PATENT OFFICE

CERTIFICATE OF CORRECTION

PATENT NO. : 4,095,493

DATED : June 20, 1978

INVENTOR(S) : Charles W. Haynes

It is certified that error appears in the above-identified patent and that said Letters Patent are hereby corrected as shown below:

Column 1, line 26 - delete "coat" and insert --cost--.

Column 4, line 12 - delete "This" and insert --The--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*